United States Patent [19]

Fischer et al.

[11] Patent Number: 4,754,904

[45] Date of Patent: Jul. 5, 1988

[54] CARRIER ASSEMBLY FOR COMPOUND BOW OR FIREARM

[76] Inventors: Alan G. Fischer, 4516 E. Pleasant Valley Rd., Independence, Ohio 44131; Edward P. Fitzgerald, 10207 Deer Run, Brecksville, Ohio 44141

[21] Appl. No.: 909,674

[22] Filed: Sep. 22, 1986

[51] Int. Cl.[4] ..... A45F 3/04

[52] U.S. Cl. ..... 224/259; 224/913; 224/916

[58] Field of Search ..... 224/257, 209, 916, 210, 224/913, 907, 922, 151, 198, 197, 200, 259, 261, 214; 211/64, 70, 7, 86; 248/274

[56] References Cited

U.S. PATENT DOCUMENTS

| | | | |
|---|---|---|---|
| 919,301 | 4/1909 | Anderson . | |
| 1,043,675 | 11/1912 | Crockett . | |
| 1,347,540 | 7/1920 | Godard | 224/190 |
| 1,466,715 | 9/1923 | Hart | 224/907 X |
| 2,316,995 | 4/1943 | Smith | 224/913 X |
| 2,781,958 | 2/1957 | Lewandoski . | |
| 2,783,896 | 3/1957 | Agostini et al. | 211/64 |
| 2,841,317 | 7/1958 | Elden | 224/907 X |
| 3,127,075 | 3/1964 | Yavello . | |
| 3,208,753 | 9/1965 | Wallace . | |
| 3,465,928 | 9/1969 | Osterholm | 224/916 X |
| 3,664,558 | 5/1972 | Tolliuer | 224/913 X |
| 3,696,978 | 10/1972 | Gentellalli | 224/916 X |
| 3,998,367 | 12/1976 | Harding . | |
| 4,073,328 | 2/1978 | Franklin | 224/916 X |
| 4,170,801 | 10/1979 | Ward | 224/922 X |
| 4,271,997 | 6/1981 | Michael | 224/913 X |
| 4,308,982 | 1/1982 | Hall | 224/917 X |
| 4,505,411 | 3/1985 | Munn | 224/913 X |

OTHER PUBLICATIONS

Page 85, Jun. 1987, Archery World, J. Wayne Fears, *Bowhunting Videos.*

Bowhunter Magazine, 1986 Deerhunting Annual, p. 11.

*Primary Examiner*—Henry J. Recla

*Assistant Examiner*—Robert M. Petrik

*Attorney, Agent, or Firm*—Fay, Sharpe, Beall, Fagan, Minnich & McKee

[57] ABSTRACT

A carrier assembly for transporting a compound bow with or without an associated side mounted arrow quiver, firearm, or the like. The carrier assembly includes a generally rigid, elongated base member having spaced, outwardly extending support structures. Elastic straps securely fasten the bow or firearm to the carrier assembly and provision is made for a quick connect/disconnect assembly. A pair of adjustable shoulder straps are disposed on the base member for receipt over a user's shoulders. Another elastic strap selectively secures the carrier assembly to a conventional, portable tree stand.

16 Claims, 4 Drawing Sheets

CARRIER ASSEMBLY FOR COMPOUND BOW OR FIREARM

BACKGROUND OF THE INVENTION

This invention pertains to the art of carrier assemblies, and more particularly to a backpack type assembly.

The invention is particularly applicable to carrying a compound bow with or without a side mount arrow quiver, or firearm, or for use in conjunction with a portable tree stand, as utilized by hunters and will be described with particular reference thereto. However, it will be appreciated that the invention has broader applications and may be advantageously employed in other environments and applications.

For purposes of this discussion, the term "weapon" will hereinafter refer to compound bows, shotguns, rifles, or other firearms unless a particular one of these members is specifically being discussed. Heretofore, game hunters have generally carried their weapons in hand sometimes sizable distances as they traverse fields, underbrush, etc. in an effort to find or reach desirable hunting locations. Often times, the terrain is difficult and at times these traversings are made in the twilight hours. Thus, hunters normally walk through the terrain with the breech of their shotguns open and unloaded in an effort to limit potential danger from accidental discharge of the gun due to an accidental mishap such as tripping and falling. Nevertheless, at least one hand or arm is required for carrying the weapon. This can become tiring and quite tedious, especially when traveling to and from and when hunting in remote areas. The ivention allows both hands and arms to be free in the traversing phase, thereby reducing the chance of tripping or falling. Fatigue becomes a reduced factor since the weapon is carried on the back.

Additionally, some hunters employ a portable tree stand to provide an advantageous, elevated vantage point for hunting. Although the tree stand can be carried by hand, it is also well known to strap the tree stand on a hunter's back to facilitate hiking over great distances. Nevertheless, the hunter still retains his weapon in one hand. Upon reaching the selected location, the hunter climbs the tree and securely mounts the tree stand for later use. A hunter will typically tie one end of a rope around the weapon and climb the tree without the weapon. From his elevated position, the weapon is pulled up to the tree stand and he settles in for the hunt. As can be expected, the weapon sometimes becomes entangled in the underbrush, thus requiring further effort to become prepared.

After a successful day in the field, a deer hunter normally guts the deer at the site of the kill. As indicated above, this is often in a remote area which necessitates dragging of the carcass over a great distance. A solitary hunter must then decide between leaving his tagged deer or his weapon behind while the other is taken back to camp. A second trip is then required to retrieve the remaining element. Thus, it is apparent, that a great need exits for transporting bows, guns, and the like in a safe manner to provide freedom of movement to both of a hunter's hands and arms.

The subject invention is deemed to meet these needs in a manner that overcomes the above-noted problems and others in a simple, economical manner.

SUMMARY OF THE INVENTION

The present invention contemplates a new and improved carrier assembly that greatly enhances present day hunting techniques.

According to the present invention, the carrier assembly includes a generally rigid base member having a support surface and means adapted for carrying the base member on the back of an associated user. Means for securing an associated weapon to the base member is also provided.

According to a more limited aspect of the invention, the carrying means includes first and second adjustable shoulder straps extending from the base member.

According to another aspect of the invention, the support surface includes first and second spaced support structures extending from the base member.

According to a more limited aspect of the invention, the support structures are pivotally secured to the base member for permitting angular adjustment relative to the base member.

According to yet another aspect of the invention, means for fastening the weapon to be transported to the carrier assembly is provided.

According to yet another aspect of the invention, means for fastening the carrier assembly to an associated portable tree stand is provided.

A principal advantage of the invention is provided through conveniently and safely transporting weapons to and from a hunting location.

Another advantage of the invention is found in freeing both hands of a user for other tasks or functions.

Yet another advantage of the invention resides in the quick connect/disconnect feature of the weapon to or from the carrier.

Yet another advantage of the invention resides in the quick connect/disconnect feature of the carrier to or from an associated portable tree stand.

Still another advantage of the invention is found in the accommodation of the carrier assembly to a conventional, portable tree stand.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
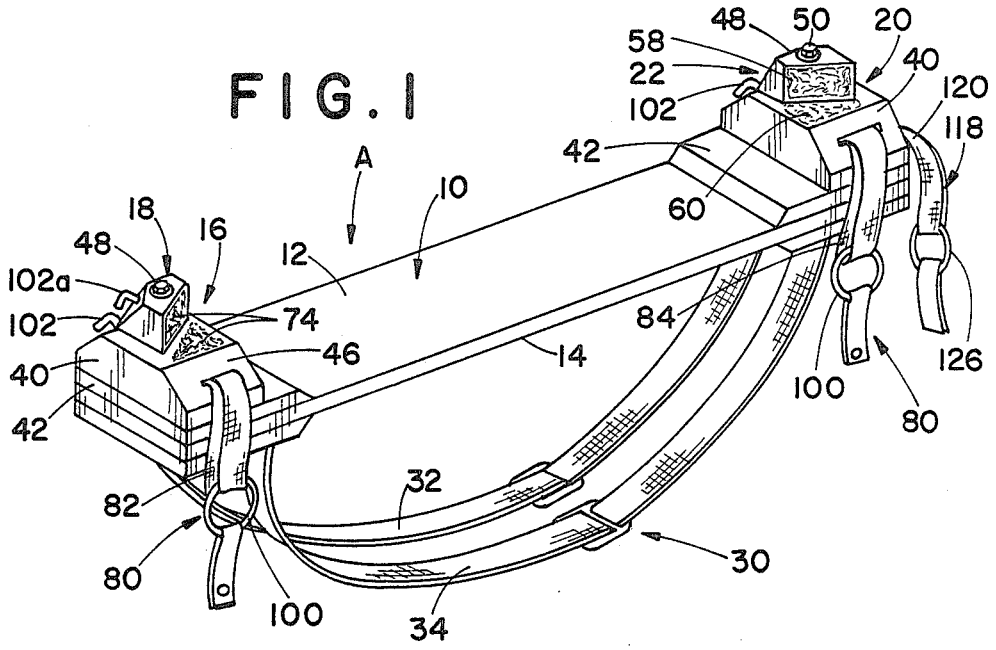
FIG. 1 is a perspective view of the carrier assembly formed in accordance with the subject invention.

Referring now to the drawings wherein the showings are for purposes of illustrating the preferred embodiment of the invention only, and not for purposes of limiting same, the FIGURES show a carrier assembly A adapted to retainingly receive a compound bow B or other unloaded firearm such as a shotgun C to facilitate transport thereof. The carrier assembly A is also adapted for use with a portable tree stand D.

More specifically, the carrier assembly includes an elongated base member 10 having opposed faces 12, 14 that may be conveniently camouflaged for purposes to be described in greater detail below. A first end region 16 of the base member includes a support structure 18 and, in similar fashion, a second end region 20 is axially spaced from region 16 to define a second support structure 22. As is particularly apparent in FIGS. 1 and 3A, the support structures 18, 22 extend outwardly in a predetermined distance from the planar region of the base member 10. This defines a recessed area 28 therebetween to facilitate receipt of a bow and assist in easy removal of the bow from the base member.

Figure 2A:
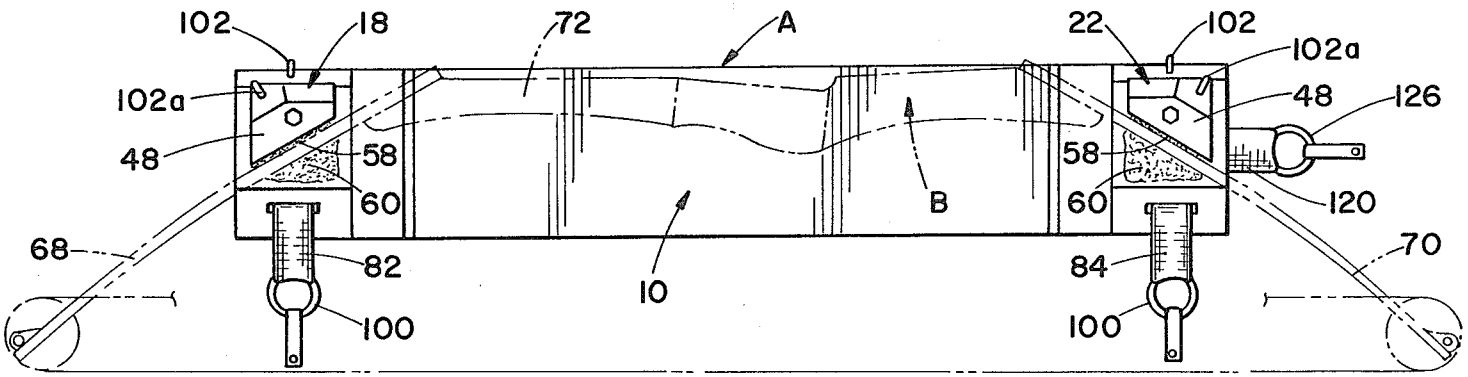
FIG. 2A is a top, plan view of the subject invention incorporating a compound bow.
Figure 2B:
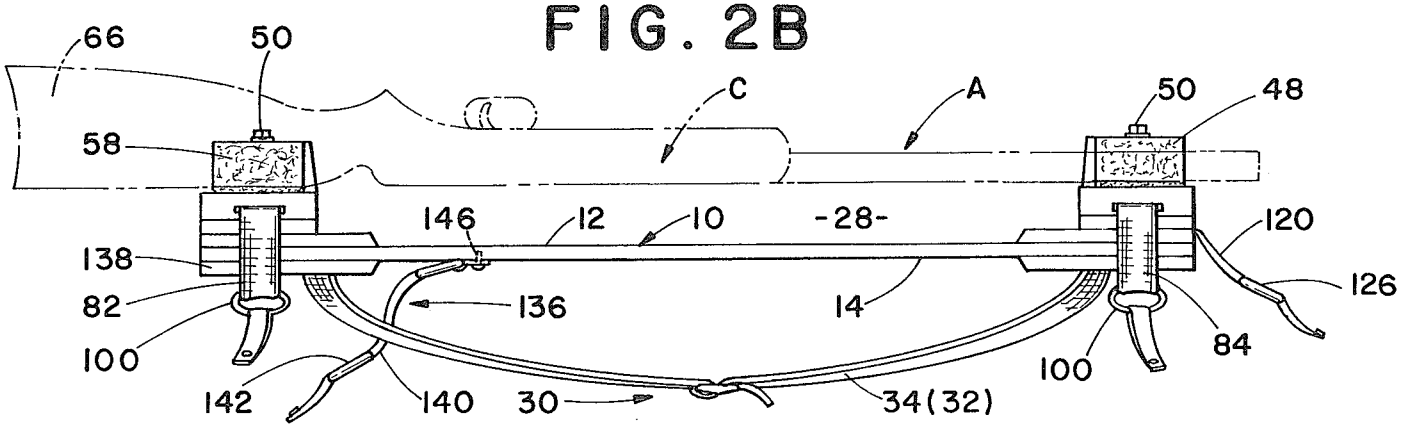
FIG. 2B is a side, elevational view of the subject invention accommodating mounting of a shotgun.

With continued reference to FIG. 1, and additional reference to FIG. 2B, means 30 adapted for carrying the base member will be described in greater detail. The carrying means 30 includes first and second elongated straps 32, 34. Opposed ends of each strap are preferably secured to the base member and extend outwardly from an opposed second face 14 thereof, although any conventional manner of fastening the straps to the base member may be utilized without departing from the scope and intent of the subject invention. Each strap is designed for adjustment of its length so as to accommodate various size users and facilitate receipt of the straps over the arms and on to the shoulders of a user. When used in this manner, the base member 10 is oriented in a generally parallel relation with the back of a user. The straps may be tightened as necessary for a comfortable fit and to distribute the load generally uniformly to the user's shoulders. Use of a pair of straps is preferred since it improves the stability of the load and adequately maintains the carrier assembly on a user's back.

The spaced support structures 18, 22 of the base member are dimensioned to receive either a compound bow B with or without a side mount arrow quiver (not shown) or a firearm such as a shotgun C. Since the support structures 18, 22 are virtually identical in construction, and for ease of illustration, like elements are identified by like numerals and their structure and function is identical unless particularly noted otherwise.

Figure 4:
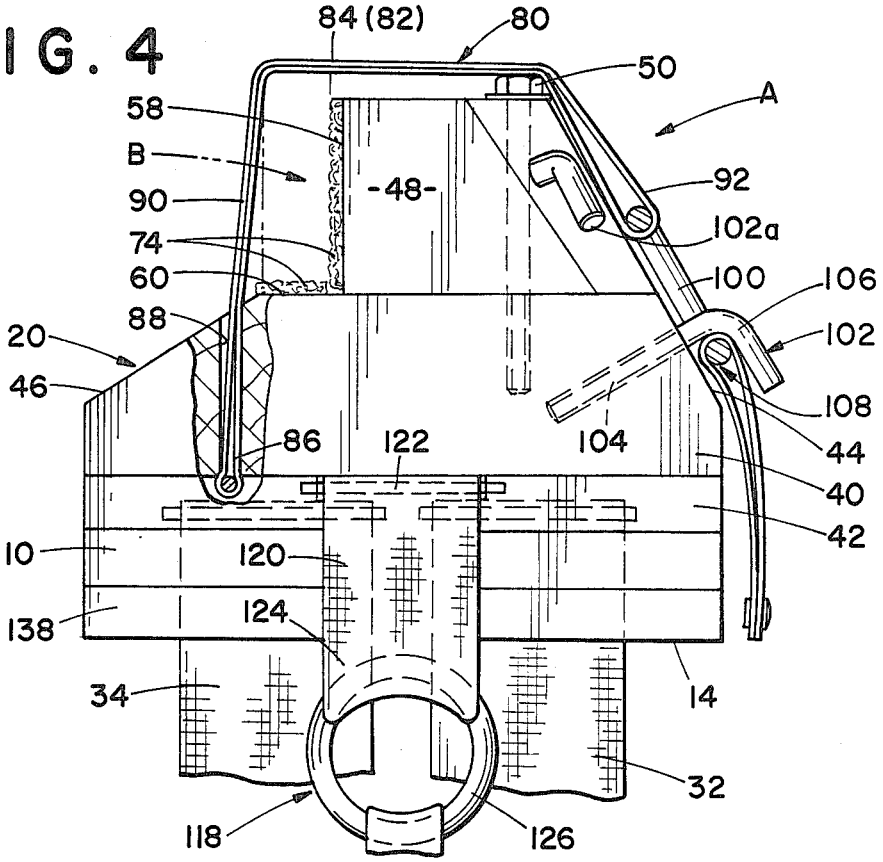
Figure 3C:
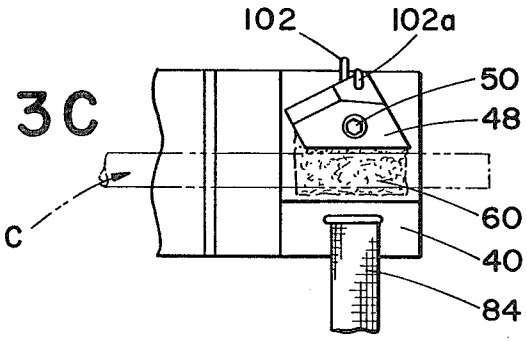
FIG. 3C is a top, plan view of one end of the subject invention detailing the adjustable support structure; and, FIG. 4 is an enlarged, end view of the subject invention specifically detailing the support and securing structure.
Figure 3A:
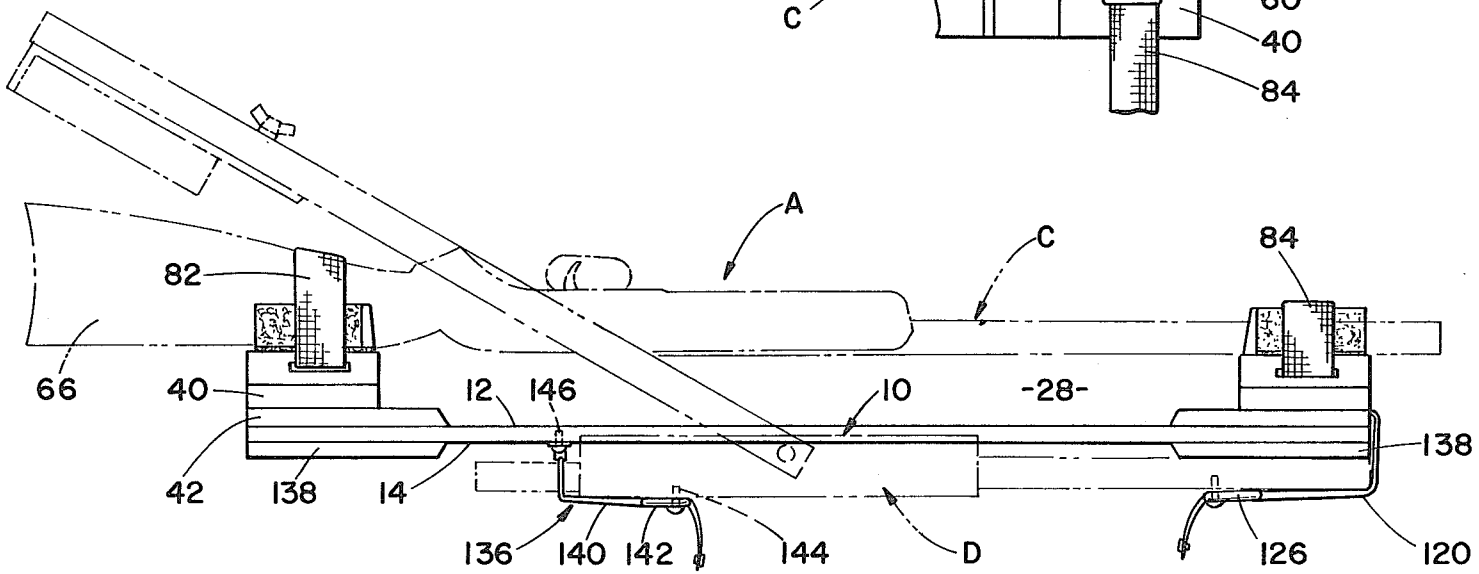
FIG. 3A is a side, elevational view of the subject invention cooperating with a conventional, portable tree stand.
Figure 3B:
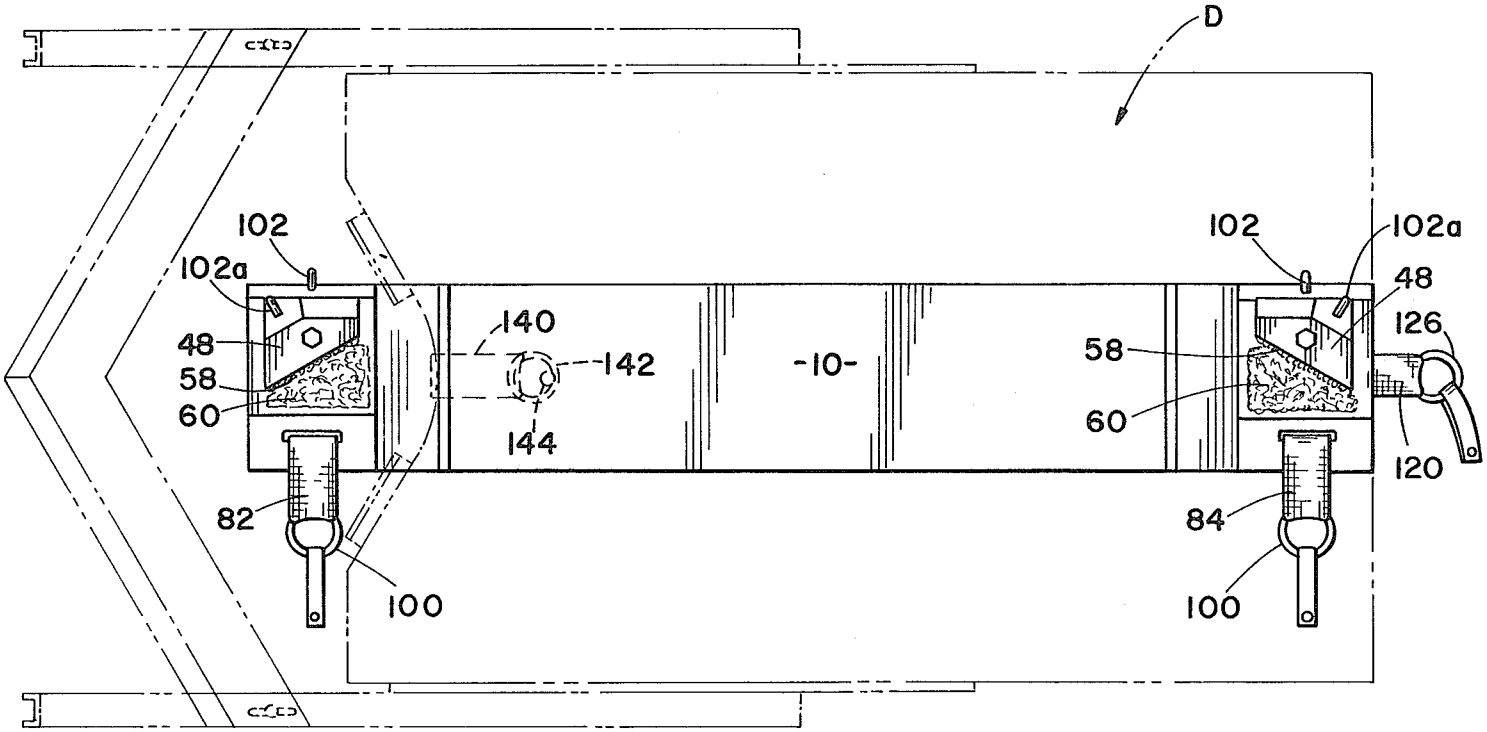
FIG. 3B is a top, plan view of the subject invention cooperating with a portable tree stand.

In accordance with the preferred embodiment, each support structure includes a support block 40 spaced from the planar portion of the base member a predetermined distance by spacer 42. As clearly shown in FIG. 4, the support block 40 and spacer 42 extend across the complete width of the base member 10. In this manner, the load is distributed over the full width of the base member. The support block 40 has generally tapered, outwardly facing surfaces 44, 46 for accommodating receipt of positioning member 48. The positioning member is adapted for pivotal movement relative to the support block 40 and base member 10 through use of a pin mounting 50. Thus as illustrated in FIGS. 2A, 3B, and 3C each positioning member 48 may be rotated in either a clockwise or counterclockwise relation. This rotation permits selected orientation of an adjustable support surface 58 (FIG. 4).

As illustrated in FIG. 2A, the support surfaces 58 are disposed in generally angular relation with the axial orientation of the elongated base member 10. These support surfaces abuttingly engage selected portions of the compound bow B along its arcuate length. Additionally, each support surface 58 cooperates with a planar support surface 60 defined along a minor portion of the support block 40. The area of the planar support surface 60 will, of course, vary as the positioning member 48 is rotated to receive the bow in FIG. 2A to receiving a firearm C as illustrated in FIGS. 2B, 3A, and 3C. Together, the adjustable support surface and planar support surface of each support structure define an L-shaped recess.

To receive the firearm C, the positioning members 48 are rotated so that the adjustable surfaces 58 are aligned in generally parallel relation with the longitudinal axis of the base member 10. The barrel of the firearm thereby abuttingly engages the angular surfaces 58, as well as planar support surfaces 60. A portion of the gun stock 66 extends axially beyond the first end region 16 of the base member in generally overhanging relation. Similarly, outer reaches 68, 70 of the conventional compound bow B extend angularly outward from the first end region 16 and second end region 20, respectively (FIG. 2A). The handle 72 of the bow is received in the recessed area 28 defined between the support structures.

To minimize scratching or other damage to the outer surface of the weapon padding means 74 is provided along the adjustable support surface 58 and planar support surface 60. The padding means may be secured to these surfaces in a manner well known in the art so that a smooth, outer surface is provided for abutting engagement with selected portions of the weapon.

Means for securing 80 the weapon to the carrier assembly A includes first and second elastic members 82, 84 operatively associated with the support structures 18, 22, respectively. Again, since the first and second elastic members are of identical construction, and for ease of illustration, like elements of the elastic members 82, 84 are identified by like numerals. A first end 86 of each elastic member is fixedly received in the spacer 42 and extends outwardly through opening 88 in the support block. The elastic member extends through the support block adjacent the planar support surface 60 and is adapted for securing engagement with the weapon along an intermediate region 90. The intermediate region 90 of each elastic member tightly engages and securely holds the weapon in place against the padding means 74.

A second or free end 92 of each elastic member receives a ring member 100. The ring member is adapted for cooperative engagement with a retainer member 102. In the preferred embodiment, the retainer member 102 has a hook shape including a first end 104 mounted in the support block 40. An outer end 106 is angularly disposed with the first end and extends from the support block to define a ring member receiving area 108. The ring member 100 and receiving area 108 define a quick connect/disconnect means on each elastic member. The elasticity of the members 82, 84 permits the ring member 100 to be stretched over the outer end 106 of the retainer member. The ring member is thereafter released and held in retaining engagement in receiving area 108.

To disconnect the elastic member, the ring member 100 is pulled around the outer end 106 and thereafter released so that the elastic member springs back to its shortened, unstretched length. It is recognized, that other quick connect/disconnect structures may be utilized without departing from the scope and intent of the subject invention. The described structure is but one embodiment that facilitates securing a weapon to the carrier assembly. In fact, each ring member in the subject invention is provided with a strip or loop of material to facilitate the quick connect/disconnect function. Adjustable straps 32, 34 are thereafter received over the hunter's shoulders and the carrier assembly used to effectively transport the weapon and free the hunter's hands for other tasks.

An alternative retainer member 102*a* is provided on the positioning member to facilitate receipt of gun stock 66. Since the gun stock extends outwardly from the support structure a greater dimension than that required for the bow, the retainer member 102*a* will receive ring member 100 of either the first or second elastic member 82, 84. This also permits the shotgun C to be oriented upwardly or downwardly when the carrier assembly A is mounted on a user's back since both support structures are adapted with an alternate retainer member to receive the gun stock.

Referring now to FIGS. 2A - 4, fastening means 118 for securely fastening the carrier assembly to an associated tree stand D will be described in greater detail. The fastening means includes at least one elastic member 120 mounted in the spacer 42 at one end 122. A second, free end 124 of the elastic member includes a ring member 126 dimensioned for cooperative engagement with a retainer member 128 on the portable tree stand D. A second elastic member 136 (FIG. 3A) extends from the opposed end region of the base member at an area adjacent stiffener 138. An outer, free end 140 of the elastic member 136 is also provided with a ring member 142 adapted for operative engagement with a retainer member 144 disposed on a lower surface of the tree stand. A similar retainer member 146 is mounted into the second face 14 of the base member for securing the elastic member 136 thereto.

The base member 10 is disposed in generally planar relation with the planar portion of the tree stand. The first elastic member 120 is stretched around one end of the tree stand for engagement with retainer member 128. Likewise, elastic member 136 extends around an opposed end of the tree stand for operative engagement with retainer member 144. Thus, and as illustrated in FIGS. 3A and 3B, the carrier assembly A is disposed in overlying, fixed relation with the tree stand D.

Straps (not shown) are typically provided on a portable tree stand so that it may be secured to the back of a user. Thus, the weapon is initially secured to the carrier assembly as described above. The elastic members 82, 84 provide a quick connect assembly which retains the weapon in fixed, abutting engagement with the padding means 74. Thereafter, the carrier assembly A is secured to the portable tree stand through use of elastic members 120, 136. The entire composite assembly is thereafter positioned on the back of a hunter through use of shoulder straps. In this manner, both hands of the hunter are left free and unoccupied. Thus, it is apparent that the carrier assembly may be used with or without a portable tree stand. In either case, the carrier assembly greatly assists a hunter in transporting his weapon.

Yet another benefit of the carrier assembly resides in the ability to hang the carrier for easy storage. The elastic member 120, particularly ring member 126, may be secured to a tree branch, hanging peg, etc. for generally vertical hanging of the carrier assembly either in the field or at home. The carrier assembly can be advantageously comouflaged for concealing purposes while hunting.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A carrier assembly for transporting an associated bow, firearm, or like member comprising:

a generally rigid base member having first and second spaced support members;

said first and second spaced support members each including an adjustable support surface selectively rotatable relative to said base member, said adjustable support surfaces generally aligned with a longitudinal axis of the base member in a first position to receive an associated firearm, and said adjustable support surfaces angularly disposed relative to the longitudinal axis of the base member in a second position to receive an associated bow;

means for carrying said base member on the back of an associated user; and, means for securing an associated bow or firearm to said base member.

2. The carrier assembly as defined in claim 1 wherein said carrying means includes first and second shoulder straps extending outwardly from said base member for receipt over an associated user's shoulders.

3. The carrier assembly as defined in claim 1 wherein said carrying means includes first and second adjustable shoulder straps extending from said base member, each strap having first and second ends secured at opposed end regions of said base member.

4. The carrier assembly as defined in claim 3 wherein said carrying means extend outwardly from a base member first surface opposed from said first and second support members.

5. The carrier assembly as defined in claim 1 wherein said securing means includes an elastic member.

6. The carrier assembly as defined in claim 5 wherein said elastic member includes one end fastened to said base member and a second end extending outwardly therefrom.

7. The carrier assembly as defined in claim 6 wherein said second end of said elastic member selectively engages retaining means operatively disposed on said base member for quick connect/disconnect therewith.

8. The carrier assembly as defined in claim 1 wherein said securing means includes first and second spaced, elastic members, each elastic member having a first end fastened to said base member and a second end for selective engagement with a retainer member operatively disposed on said base member.

9. The carrier assembly as defined in claim 1 further comprising means for fastening said base member to an associated portable tree stand.

10. The carrier assembly as defined in claim 9 wherein said fastening means includes a member having one end secured to said base member and a second end adapted for selective engagement with the asociated tree stand.

11. A carrier assembly for transporting an associated bow, firearm, or the like, said carrier assembly comprising:

an elongated base member having first and second opposed faces;

angularly adjustable means for supporting an associated bow or firearm adjacent said first face;

said supporting means including first and second spaced support surfaces selectively rotatable relative to said base member, said support surfaces generally aligned with a longitudinal axis of the base member in a first position to receive an associated firearm, and said support surfaces angularly disposed relative to the longitudinal axis of the base member in a second position to receive an associated bow, padding means defined on said support surfaces, said padding means disposed for abutting engagement with the associated bow or firearm to minimize damage to the external surface thereof;

means cooperating with said supporting means for securing an associated bow or firearm; and, means operatively disposed on said second face for carrying said base member on the back of an associated user.

12. The carrier assembly as defined in claim 11 wherein said securing means includes an elastic member having one end mounted in fixed relation with said base member and a second end for selective engagement with a retaining member whereby one of the associated bow and firearm is retainingly held against said supporting means.

13. The carrier assembly as defined in claim 11 wherein said carrying means includes adjustable straps for receipt over an associated user's shoulders whereby said base member is carried on the associated user's back.

14. The carrier assembly as defined in claim 11 further comprising a member extending outwardly from said base member whereby a free end thereof is received on an associated tree stand.

15. A carrier assembly for transporting an associated bow or firearm, said carrier assembly comprising:

a generally rigid base member having axially spaced first and second support members on one face thereof, said first and second support members each including an adjustable support surface selectively rotatable relative to said base member, said adjustable support surfaces generally aligned with a longitudinal axis of the base member in a first position to receive an associated firearm, and said adjustable support surfaces angularly disposed relative to the longitudinal axis of the base member in a second position to receive an associated bow;

first and second adjustable shoulder straps extending outwardly from an opposed, second face of said base member and adapted for receipt over an associated user's shoulders;

an elastic strap operatively extending from said base member for selectively securing the associated bow or firearm to said support members; and, means for selectively fastening said base member to said portable tree stand.

16. The carrier assembly as defined in claim 15 wherein said elastic strap has a free end including a ring member dimensioned for quick connect/disconnect with a retaining hook disposed on said base member.

* * * * *